US011651915B2

(12) United States Patent
Wong

(10) Patent No.: US 11,651,915 B2
(45) Date of Patent: May 16, 2023

(54) ELECTRICAL SWITCH DEVICE

(71) Applicant: DEFOND ELECTECH CO., LTD, Dongguan (CN)

(72) Inventor: Kin Yu Wong, Dongguan (CN)

(73) Assignee: DEFOND ELECTECH CO., LTD, Dongguan (CN)

( * ) Notice: Subject to any disclaimer, the term of this patent is extended or adjusted under 35 U.S.C. 154(b) by 0 days.

(21) Appl. No.: 17/575,574

(22) Filed: Jan. 13, 2022

(65) Prior Publication Data

US 2022/0246373 A1 Aug. 4, 2022

(30) Foreign Application Priority Data

Jan. 29, 2021 (HK) ..... 32021024577.7

(51) Int. Cl.
*H01H 23/06* (2006.01)
*H01H 23/16* (2006.01)
*H01H 23/28* (2006.01)

(52) U.S. Cl.
CPC ..... *H01H 23/16* (2013.01); *H01H 23/06* (2013.01); *H01H 23/28* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20; H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26
See application file for complete search history.

(56) References Cited

U.S. PATENT DOCUMENTS 4,454,398 A * 6/1984 Aschenbach ..... H01H 23/065 200/305
2003/0174590 A1* 9/2003 Arikawa ..... G04B 37/106 368/319
2018/0247777 A1* 8/2018 Kim ..... H01H 13/50

* cited by examiner

*Primary Examiner* — Ahmed M Saeed
(74) *Attorney, Agent, or Firm* — Nitin Kaushik

(57) ABSTRACT

An electrical switch device including a switch housing having first and second compartments separated by a partition; an electrical switch assembly disposed in the second compartment; a control knob configured for seating adjacent to the first compartment, and having a user engagement portion and a plunger configured to extend from user engagement portion from the first compartment in to the second compartment via an opening in the partition separating the first and second compartments when the control knob is seated, and said plunger being configured for movable interaction with the electrical switch assembly; and a sealing member including a base portion configured for securing of the sealing member to the housing, and, a tubular portion extending from the base portion and configured to surround the plunger so as to alleviate ingress of liquid from the first compartment in to the second compartment via the opening in the partition.

9 Claims, 5 Drawing Sheets

ELECTRICAL SWITCH DEVICE

TECHNICAL FIELD

The present invention relates to the field of electrical switch devices such as rocker switches and push-button switches.

BACKGROUND OF THE INVENTION

In certain electrical switch devices such as rocker switches and push-button switches it is important to suitably seal the electrical switch components from contamination by water, dust and other contaminants so as to alleviate potential damage being caused to the electrical switch components. Current design methods used for manufacturing such electrical switch devices with requisite sealing capability are perceived to be open to improvement in terms of assembly time, costs and labour.

SUMMARY OF THE INVENTION

The present invention seeks to alleviate at least one of the above-described problems. The present invention may involve several broad forms. Embodiments of the present invention may include one or any combination of the different broad forms herein described.

In a first broad form, the present invention provides an electrical switch device including:

a switch housing having first and second compartments separated by a partition;

an electrical switch assembly disposed in the second compartment;

a control knob configured for seating adjacent to the first compartment, and having a user engagement portion and a plunger configured to extend from user engagement portion from the first compartment in to the second compartment via an opening in the partition separating the first and second compartments when the control knob is seated, and said plunger being configured for movable interaction with the electrical switch assembly to open and close an electrical switch of the electrical switch assembly in response to user-operable movement of the control knob amongst a plurality of operational positions; and a sealing member including a base portion configured for securing of the sealing member to the housing, and, a tubular portion extending from the base portion and configured to surround the plunger so as to alleviate ingress of liquid from the first compartment in to the second compartment via the opening in the partition.

Preferably, a lip of the tubular portion of the sealing member may be configured for being received within a notch or groove disposed in the control knob so as to effect securement of the tubular portion to the control knob.

Preferably, the lip of the tubular portion may be configured for snap-fitting engagement with the notch or groove disposed in the control knob.

Preferably, in certain embodiments the position of the notch or groove and the lip may be reversed—that is, the notch or groove may be disposed on the tubular portion of the sealing member whilst the lip may be disposed on the control knob.

Preferably, the base portion of the sealing member may include a substantially planar configuration.

Preferably, the sealing member may include at least one of a rubber and a polymeric material.

Preferably, the base portion of the sealing member may form at least a portion of the partition separating the first and second compartments of the housing.

Preferably, the base portion of the sealing member may be over-molded with a portion of the first housing.

Preferably, the present invention may include a plurality of electrical terminals for electrically connecting the electrical switch of the switch assembly in the second compartment with an external device, said electrical terminals extending outwardly of a wall of the second compartment.

Preferably, the plurality of electrical terminals may be insert molded with at least a portion of the second compartment.

Preferably, at least one vent disposed may be disposed in a wall of the first compartment of the housing.

BRIEF DESCRIPTION OF THE DRAWINGS

The present invention will become more fully understood from the following detailed description of a preferred but non-limiting embodiments thereof, described in connection with the accompanying drawings, wherein.

DETAILED DESCRIPTION OF PREFERRED EMBODIMENTS

Figure 1:
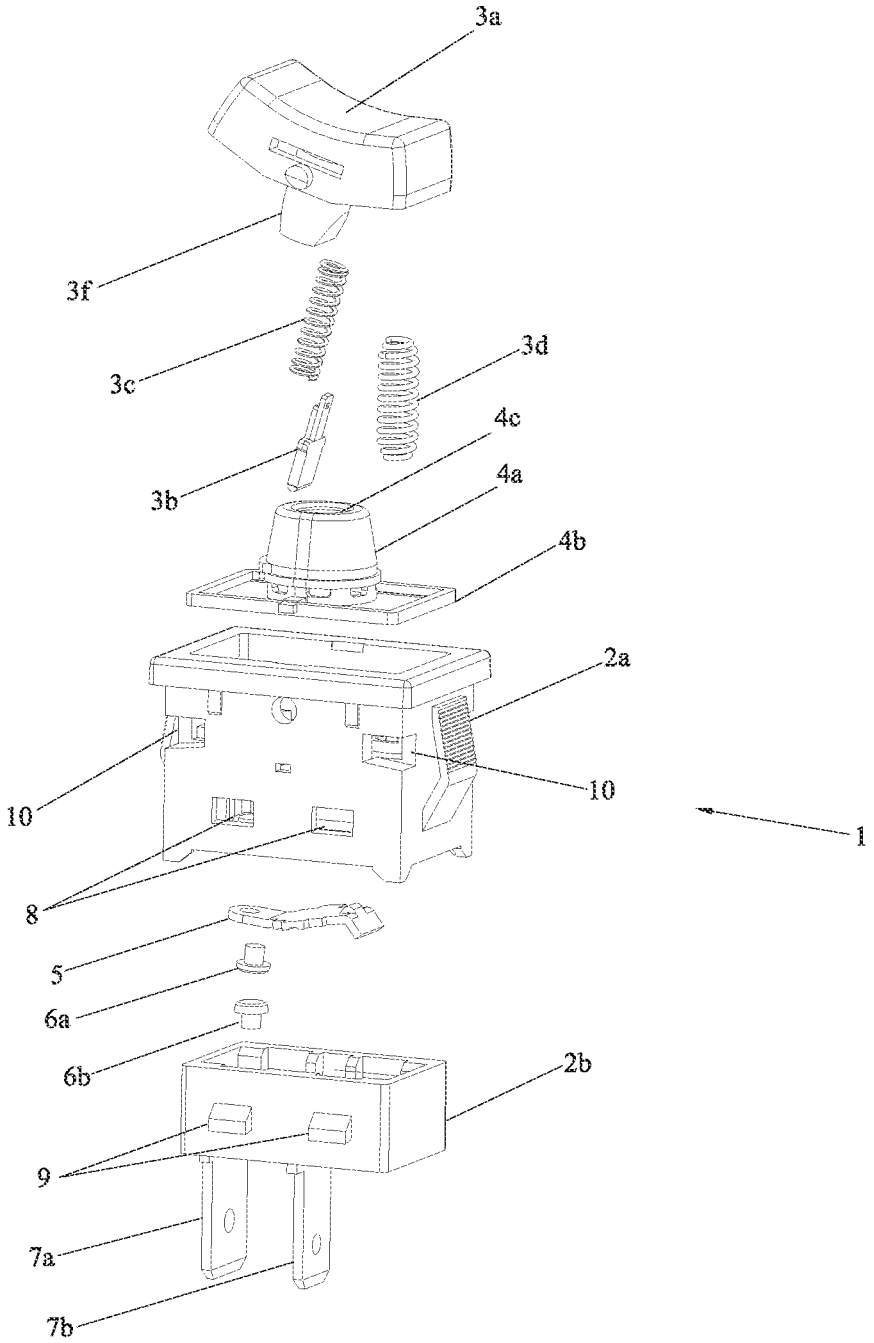
FIG. 1 shows an exploded perspective view of an embodiment of the present invention.
Figure 2:
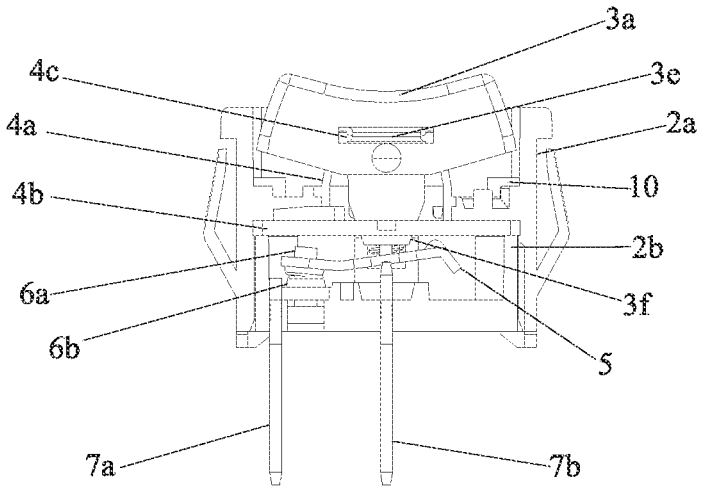
FIG. 2 shows a side partial cut-away view of an embodiment of the present invention.
Figure 3:
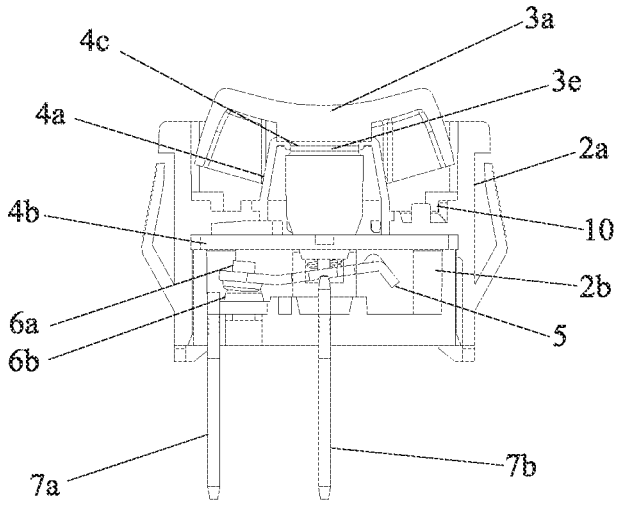
FIG. 3 shows a side cut-away view of an embodiment of the present invention.
Figure 4:
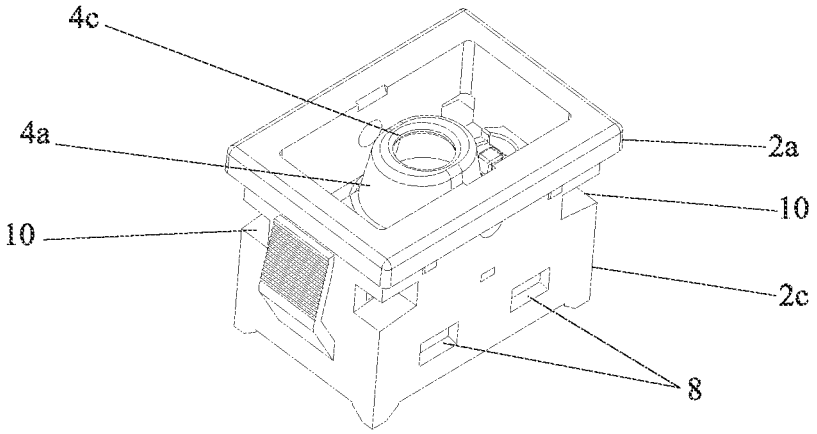
FIG. 4 shows to a top perspective view of a first compartment of the housing with the sealing member formed therein in accordance with an embodiment of the present invention and with the control knob detached.
Figure 5:
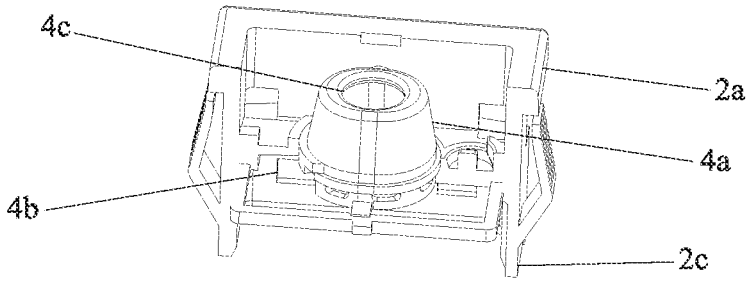
FIG. 5 shows a top perspective partial cut-away view of the first compartment of the housing with the sealing member formed therein in accordance with an embodiment of the present invention and with the control knob detached.
Figure 6:
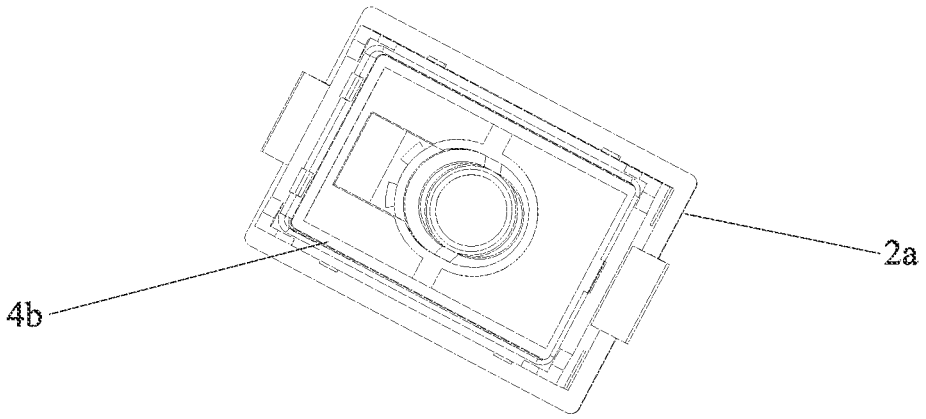
FIG. 6 shows a bottom view of the first compartment of the housing with the sealing member formed therein in accordance with an embodiment of the present invention.
Figure 7:
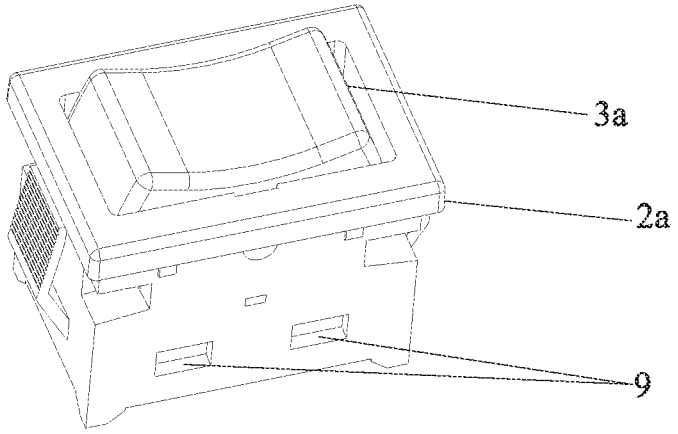
FIG. 7 shows a top perspective view of the first compartment of the housing with the control knob assembled thereto in accordance with an embodiment of the present invention.
Figure 8:
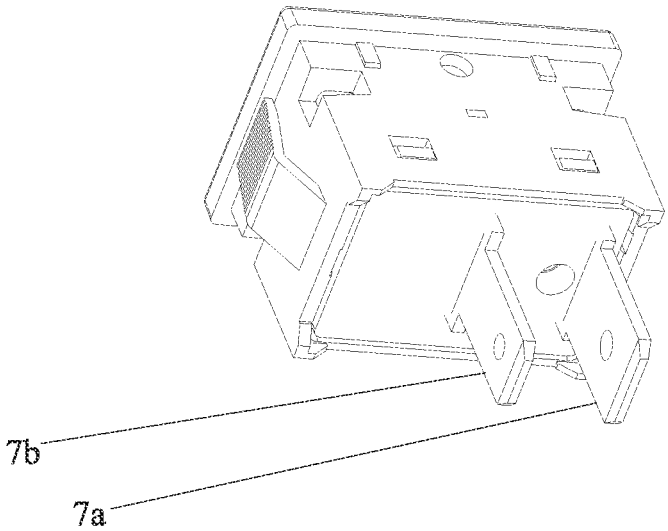
FIG. 8 shows a bottom perspective view of the electrical switch device in accordance with an embodiment of the present invention.
Figure 9:
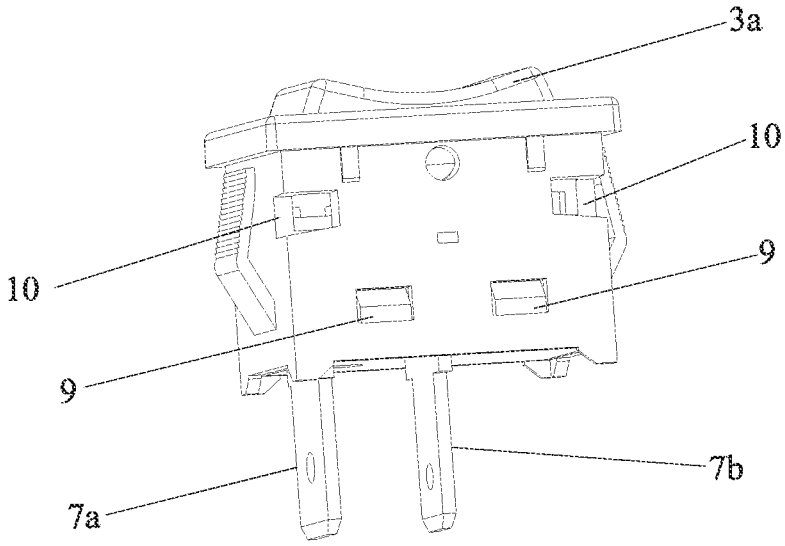
FIG. 9 shows a side perspective view of the electrical switch device in accordance with an embodiment of the present invention.

Preferred embodiments of the present invention will now be described herein with reference to FIGS. 1 to 9. The embodiments comprise a novel rocker-type switch (1) comprising a switch housing (2*a*, 2*b*), an electrical switch assembly (5, 6*a*, 6*b*) disposed in the second compartment (2*b*), a control knob (3*a*, 3*b*) for controlling operational modes of an electrical switch of the electrical switch assembly (5, 6*a*, 6*b*), and a sealing member (4*a*, 4*b*) disposed between the control knob (3*a*, 3*b*) and the first compartment (2*a*) of the housing (2*a*, 2*b*). Although these embodiments will be described in relation to a rocker-type switch for ease of generally understanding, it will be appreciated that embodiments of the present invention may be similarly applicable to other types of electrical switch devices including push-button type switches as well.

The electrical switch assembly (5, 6*a*, 6*b*) includes an electrical switch (5, 6*a*, 6*b*) with at least one stationary switch contact (6*a*) and one movable switch contact (6*b*) mounted on a contact lever (5) that are configured for movement relative to each other between opened and closed configurations so as to electrically open and close the electrical switch (5, 6*a*, 6*b*) responsive to user-operable movement of the control knob (3*a*, 3*b*) and thereby allow or restrict flow of current through the electrical switch (5, 6*a*, 6*b*) respectively. A pair of electrical switch terminals (7*a*, 7*b*) is configured for electrically connecting the electrical switch (5, 6*a*, 6*b*) of the switch assembly (5, 6*a*, 6*b*) in the second compartment (2*b*) with an external device. The pair of electrical switch terminals (7*a*, 7*b*) extends outwardly of a bottom wall of the second compartment (2*b*) and may be insert-molded with at least a portion of the second compartment (2*b*).

The first and second compartments (2*a*, 2*b*) of the housing are generally rectangular shaped and are separately formed by injection molding from rigid plastic or other suitably rigid metal or polymeric materials. The first compartment (2*a*) includes a skirt portion (2*c*) extending from a lower end of the first compartment (2*a*) and which includes a plurality of receiving slots (8) configured for snap-fitting engagement with a plurality of corresponding tabs (9) disposed on an outer surface of the second compartment (2*b*) when the lower end of the first compartment (2*a*) is seated on a top end of the second compartment (2*b*). Such an arrangement assists in speed and ease of assembly of the first and second housing compartments (2*a*, 2*b*) together during manufacturing.

The sealing member includes a base portion (4*b*) having a substantially planar configuration and a tubular portion (4*a*) extending from the base portion (4*b*) along an axis that is substantially perpendicular to the planar configuration of the base portion (4*b*). The sealing member (4*a*, 4*b*) is integrally formed from a rubber material or other suitably polymeric material and is conveniently in-built in to the housing (2*a*, 2*b*). For instance, the base portion (4*b*) may be over-molded in to a portion of the first compartment (2*a*) so as to at least partially form a partition between the first and second compartments (2*a*, 2*b*) when they are snap-fitted together. Conveniently, because the sealing member (4*a*, 4*b*) may be in-built in to the housing (2*a*, 2*b*) this obviates the additional assembly time, cost and labour required to fit an additional stand-alone sealing panel member in to the housing. Furthermore, as the sealing member (4*a*, 4*b*) is in-built in to the housing (2*a*, 2*b*), the risk of dislodgement of the sealing member (4*a*, 4*b*) is reduced.

The control knob (3*a*, 3*b*) includes a user engagement portion (3*a*) to allow the user's finger to rock the rocker switch amongst a plurality of operational positions, and, an actuator plunger (3*b*) extending from a stem (3*f*) of the user engagement portion (3*a*). A contact spring (3*c*) is disposed between a lower surface of the stem (3*f*) and the plunger (3*b*) whilst a return spring (3*d*) is also disposed between the user engagement portion (3*a*) and the first compartment (2*a*) or sealing member (4*b*) to provide for biased momentary movement of the control knob (3*a*, 3*b*) amongst a plurality of operational positions. The control knob (3*a*, 3*b*) sits above the sealing member (4*a*, 4*b*) when the electrical switch device is fully assembled together and the stem (3*f*) and plunger (3*b*) are configured to extend in a direction through the tubular portion (4*a*) of the sealing member from the first compartment (2*a*) towards the second compartment (2*b*). The plunger (3*b*) is able to movably interact with the electrical switch assembly (5, 6*a*, 6*b*) to electrically open and close the electrical switch (5, 6*a*, 6*b*) of the electrical switch assembly (5, 6*a*, 6*b*) in response to user-operable movement of the control knob (3*a*, 3*b*). Conveniently, the in-built sealing member (4*a*, 4*b*) alleviates ingress of water and other particulates from the first compartment (2*a*) in to the second compartment (2*b*) as the plunger is moved and thereby alleviates potential damage being caused to the electrical switch assembly (5, 6*a*, 6*b*).

Round bolts are mostly used in the existing plungers, since there is no support point, plungers cannot swing left and right. Besides, the existing stem has a support point, if there is no plunger, the switch cannot be started up. However, the stem (3*f*) and the user engagement portion (3*a*) (namely the button) of the present invention are integrally formed and cooperated with the plunger (3*b*) so as to truly achieve a rocker switch function.

In the present invention, strip-shaped holes are respectively formed on both sides of the user engagement portion (3*a*) (not shown in the figures, which is located above pivot shafts on the front and rear sides of the user engagement portion 3*a*), so that the integrally-formed user engagement portion (3*a*) and the stem (3*f*) can be easily demolded, while the stem integrally formed with the button cannot be demolded without the strip-shaped holes design.

The existing button and the stem are formed separately, which will reduce the internal space of the switch, so that the return spring cannot be arranged hereon, which limits the functional designs, such as switch automatic reset. In the present invention, the user engagement portion (3*a*) and the stem (3*f*) are integrally formed, which can increase the internal space of the switch, so that the return spring (3*d*) can be arranged hereon, thereby the rocker switch is provided with an automatic reset function.

In these preferred embodiments the tubular portion (4*a*) of the sealing member (4*a*, 4*b*) further includes a lip (4*c*) which is configured for snap-fitting engagement within a groove (3*e*) disposed around a periphery of the stem (3*f*) of the control knob so as to effect securement of the tubular portion (4*a*) to the control knob. It is possible for the position of the groove and the lip to be reversed—that is, the groove may be disposed on the tubular portion of the sealing member whilst the lip may be disposed on the control knob. Conveniently, this arrangement provides a relatively quick and simple process by which the control knob may be secured to the sealing member. Also conveniently, a relatively rounded annular periphery of the tubular member provides a curved contour to allow smooth rocking of the control knob thereon. Also conveniently, the rubber sealing member also provides cushioning for the control knob which both reduces wear and tear in the control knob due to repeated rocking upon the sealing member, but which may additionally provide improved hand-feel for the user when rocking the control knob.

The existing sealing member requires to be inner buckle matched with the stem to provide waterproof function, but the existing stem cannot achieve an inner buckle match but must be accompanied with a button. The stem (3*f*) and the user engagement portion (3*a*) (namely the button) of the present invention are integrally formed, the groove (3*e*) disposed around a periphery of the stem (3*f*) can achieve the internal buckle match of the tubular portion (4*a*), so that can realize waterproof protection function in company with the sealing member (4*a*, 4*b*). In addition, the groove (3*e*) is configured to be lower than the switch housing, which can achieve the waterproof function in company with the sealing member (4*a*, 4*b*) without affecting the design.

The electrical switch device of the present invention can achieve the waterproof function through a tight pressing-assembling design among the control knobs (3*a*, 3*b*), the sealing member (4*a*, 4*b*), and the switch housings (2*a*, 2*b*); and a high IP level (IP67) and an instantaneous function can be achieved without additional waterproof protection treatment on the switch body. The tight pressing-assembling design of the present invention can be further extended to the push switches.

In preferred embodiments of the present invention at least one vent (10) is disposed in a wall of the first compartment (2*a*) of the housing to allow for water, dust and other particulates to be evacuated from the first compartment (2*a*) and thus further alleviate risk of such contaminants from entering the second compartment (2*b*) from the first compartment (2*a*). By way of example 4 vents (10) may be disposed in space-apart fashion around the wall of the first compartment (2*a*).

Those skilled in the art will appreciate that the invention described herein is susceptible to variations and modifications other than those specifically described without departing from the scope of the invention. All such variations and modification which become apparent to persons skilled in the art, should be considered to fall within the spirit and scope of the invention as broadly hereinbefore described. It is to be understood that the invention includes all such variations and modifications. The invention also includes all of the steps and features, referred or indicated in the specification, individually or collectively, and any and all combinations of any two or more of said steps or features.

The reference to any prior art in this specification is not, and should not be taken as, an acknowledgment or any form of suggestion that that prior art forms part of the common general knowledge.

What is claimed is:

1. An electrical switch device including:

a switch housing having first and second compartments separated by a partition;

an electrical switch assembly disposed in the second compartment;

a control knob configured for seating adjacent to the first compartment, and having a user engagement portion and a plunger configured to extend from user engagement portion from the first compartment in to the second compartment via an opening in the partition separating the first and second compartments when the control knob is seated, and said plunger being configured for movable interaction with the electrical switch assembly to open and close an electrical switch of the electrical switch assembly in response to user-operable movement of the control knob amongst a plurality of operational positions; and a sealing member including a base portion configured for securing of the sealing member to the housing, and, a tubular portion extending from the base portion and configured to surround the plunger so as to alleviate ingress of liquid from the first compartment in to the second compartment via the opening in the partition, wherein a lip of the tubular portion of the sealing member is configured for being received within a notch or groove disposed in the control knob so as to effect securement of the tubular portion to the control knob, wherein the lip of the tubular portion is configured for snap-fitting engagement with the notch or groove disposed in the control knob.

2. The electrical switch device as claimed in claim 1, wherein the position of the notch or groove and the lip are reversed.

3. The electrical switch device as claimed in claim 1, wherein the base portion of the sealing member includes a substantially planar configuration.

4. The electrical switch device as claimed in claim 1, wherein the sealing member includes at least one of a rubber and a polymeric material.

5. The electrical switch device as claimed in claim 1, wherein the base portion of the sealing member forms at least a portion of the partition separating the first and second compartments of the housing.

6. The electrical switch device as claimed in claim 1, wherein the base portion of the sealing member is overmolded with a portion of the first compartment.

7. The electrical switch device as claimed in claim 1, further including a plurality of electrical terminals for electrically connecting the electrical switch of the switch assembly in the second compartment with an external device, said electrical terminals extending outwardly of a wall of the second compartment.

8. The electrical switch device as claimed in claim 7, wherein the plurality of electrical terminals are insert molded with at least a portion of the second compartment.

9. The electrical switch device as claimed in claim 1, further including at least one vent disposed in a wall of the first compartment of the housing.

* * * * *